US005950370A

United States Patent [19]

Peck

[11] Patent Number: 5,950,370

[45] Date of Patent: Sep. 14, 1999

[54] BATHTUB SUPPORT AND SEALING FLANGE

[75] Inventor: William L. Peck, Arlington, Tex.

[73] Assignee: CR/PL, L.L.C., Evanston, Ill.

[21] Appl. No.: 08/821,403

[22] Filed: Mar. 20, 1997

[51] Int. Cl.[6] ..... A47K 3/16

[52] U.S. Cl. ..... 52/35; 52/716.1; 52/716.2; 4/584

[58] Field of Search ..... 52/34, 35, 716.1, 52/717.01, 718.01, 716.2; 4/584

[56] References Cited

U.S. PATENT DOCUMENTS

| | | | |
|---|---|---|---|
| 2,533,591 | 12/1950 | Barre | 52/35 |
| 4,316,295 | 2/1982 | Whitney et al. | 52/34 X |
| 4,601,149 | 7/1986 | Dokan | 52/35 X |
| 4,691,392 | 9/1987 | Whitney | 52/716.2 X |
| 4,719,733 | 1/1988 | Seles | 52/35 |
| 4,829,730 | 5/1989 | Zeilinger | 52/35 X |
| 4,837,997 | 6/1989 | Zeilinger | 52/35 X |
| 4,879,858 | 11/1989 | Murdoch | 4/584 X |
| 4,893,450 | 1/1990 | Donaldson et al. | 52/35 |
| 5,159,723 | 11/1992 | Benedict | 52/34 X |

*Primary Examiner*—Creighton Smith
*Attorney, Agent, or Firm*—Hovey, Williams, Timmons & Collins

[57] ABSTRACT

A flexible extrusion molded flange for securing bathtubs and the like to surrounding walls while simultaneously providing a moisture barrier therebetween. The flange snaps on to the vertical edge and horizontal deck of the tub. The flange includes a vertical back strip for securing the flange to a stud wall, a drywall sealing lip forming a moisture barrier between the tub and the drywall, a finish wall sealing strip for sealing and aligning the finish wall, and a tub edge securing strip for receiving the edge of the tub. Miter cut corners and silicone sealants enhance the flange's moisture barrier properties.

14 Claims, 2 Drawing Sheets

BATHTUB SUPPORT AND SEALING FLANGE

BACKGROUND OF THE INVENTION

The present invention relates to devices for securing bathtubs to walls, and to devices for preventing moisture from the tub or shower from entering the surrounding walls. More particularly, the present invention relates to a flexible, extrusion molded flange, which snaps onto the edge of a tub and provides a means for securing the tub against the wall while simultaneously forming a moisture barrier between the tub deck, the finish wall, and the underlying drywall.

Moisture penetration of the crack between a bathtub deck and the surrounding walls can damage the walls and flooring beneath the tub. Because of the tub's weight, especially when filled water and a person using the tub, tub installations present the additional problem of the tub tending to pull away from the surrounding wall. Several methods have been invented to secure the tub against the surrounding walls and to create a moisture barrier between the tub deck and the walls.

U.S. Pat. No. 4,204,376 to Calvert (1980) teaches a molding which engages the edge of the bathtub and through which the tub is secured to the wall by nails being driven through the molding and the bathtub flange into the wall. Such a system secures the tub to the wall, but does not provide a moisture barrier.

U.S. Pat. No. 4,290,154 to Benjamin (1981) also teaches a wall-mounted bracket attached to the edge of a bathtub, the bracket being anchored to the wall with nails or screws. The tub deck is provided with a rib upon which the drywall or finish wall can be rested, but a moisture barrier is absent and caulking or grouting is essential.

U.S. Pat. No. 4,837,997 to Zeilinger (1989) addresses the problem of sealing the crack between the tub deck and the wall. Zeilinger teaches a sealing system including three generally L-shaped sealing strips and a corner piece for covering the corner where the joints meet. The sealing strips and corner pieces are held in place against the wall and tub deck with a suitable adhesive. While such sealing systems may provide an effective barrier to moisture entry between the tub deck and the wall, they do not simultaneously solve the problem of supporting the weight of the bathtub against the wall.

Modern building codes are increasingly requiring that bathtubs intended for installation against a wall incorporate a raised flange which extends at least 7.9 mm (5/16 inch) above the tub deck, which should form an effective moisture barrier between the tub and flange. See American National Standards, ANSI 7-124.1-1995.

While prior art tub support flanges, such as the Crane Snap-on Flange, provide tub support and some moisture barrier properties, it provides no specific moisture barrier between the finish wall and drywall, nor any edge upon which to align and seal the finish wall (typically ceramic tiles).

SUMMARY OF THE INVENTION

To overcome the disadvantages of the foregoing systems for supporting and sealing a tub against a surrounding wall, the present invention has as its primary object to provide an extrusion molded flange which snaps onto the edge of a bathtub providing a vertical back strip for fastening the flange to the underlying stud wall, a drywall sealing lip, a finish wall sealing strip, all integrally molded by the extrusion process using a strong yet resilient plastic material. The snap-on design eliminates the need for complicated wall mounting brackets, while the moisture barrier properties eliminates the need for separate sealing systems, as both the tub support and sealing properties are provided by the extrusion molded flange described herein.

The invention described herein exceeds ANSI 7-124.1-1995 requirements. The invention also provides an additional moisture barrier between the finish wall (ceramic tile or a plastic wall surround) and the underlying drywall. Further, the invention described herein provides an aligning edge and seal for the finish wall.

Accordingly, besides the objects and advantages of the invention described above, several objects and advantages of the present invention are:

a. to provide a means for securing a bathtub, sink or the like, to a wall;

b. to provide a means for sealing the joint between the bathtub and wall so as to form a moisture barrier therebetween;

c. to provide a drywall sealing lip to form a moisture barrier between the finish wall and the underlying drywall;

d. to provide a finish wall sealing strip to form a moisture barrier between the tub deck and the finish wall, which may be ceramic tile or a plastic wall surround;

e. to provide a final silicone seal between the finish wall sealing strip and the tub deck to further strengthen the moisture barrier between the tub deck and the finish wall sealing strip;

f. to provide a layer of silicone adhesive to seal the tub edge securing strip to the tub edge, thereby forming an additional moisture barrier therebetween;

g. to provide a flange shape which readily snaps on to the tub edge and tub deck to facilitate installation; and h. to provide a flange which can be miter cut at the corners formed by intersecting walls to provide a moisture barrier in the corners.

DETAILED DESCRIPTION OF THE PREFERRED EMBODIMENTS

Figure 1:
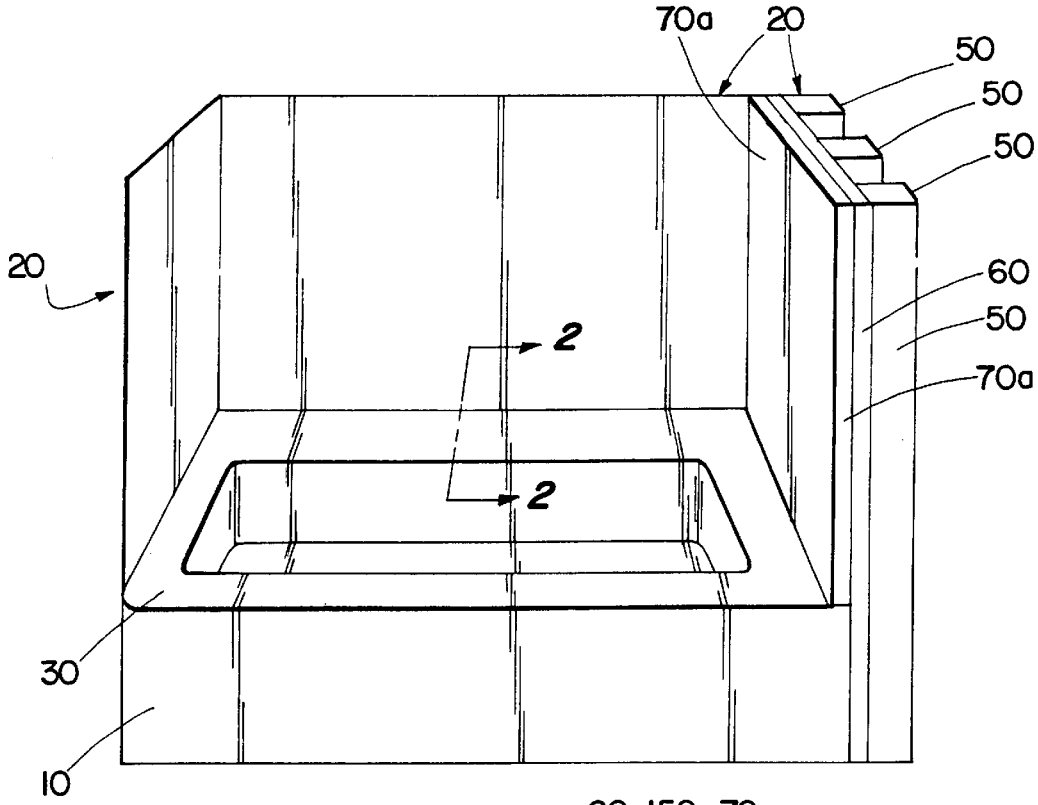
FIG. 1 is a diagram of a bathtub enclosed by three surrounding walls.
Figure 2:
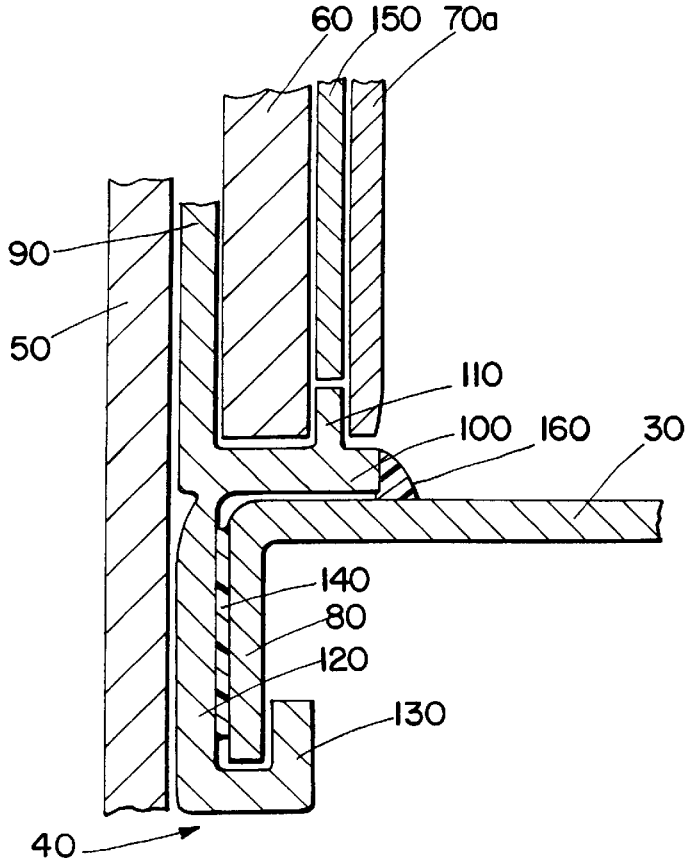
FIG. 2 is a schematic diagram taken substantially along a line 2—2 of FIG. 1, illustrating in cross-section how the flange relates to the tub edge, tub deck, wall studs, drywall, and a ceramic tile finish wall.

Now turning to the drawings, FIG. 1 shows a bathtub 10 enclosed by walls 20 on three sides. The tub has a horizontal deck 30, the surface of which is perpendicular to the walls 20. The wall 20 includes a stud 50, a sheet of drywall 60, and a finish wall 70*a*, 70*b*. FIG. 2 is a cross-sectional view along line 2—2 of FIG. 1 and shows the relationship between the wall 20, the tub deck 30, and the tub support and sealing flange 40.

Figure 3:
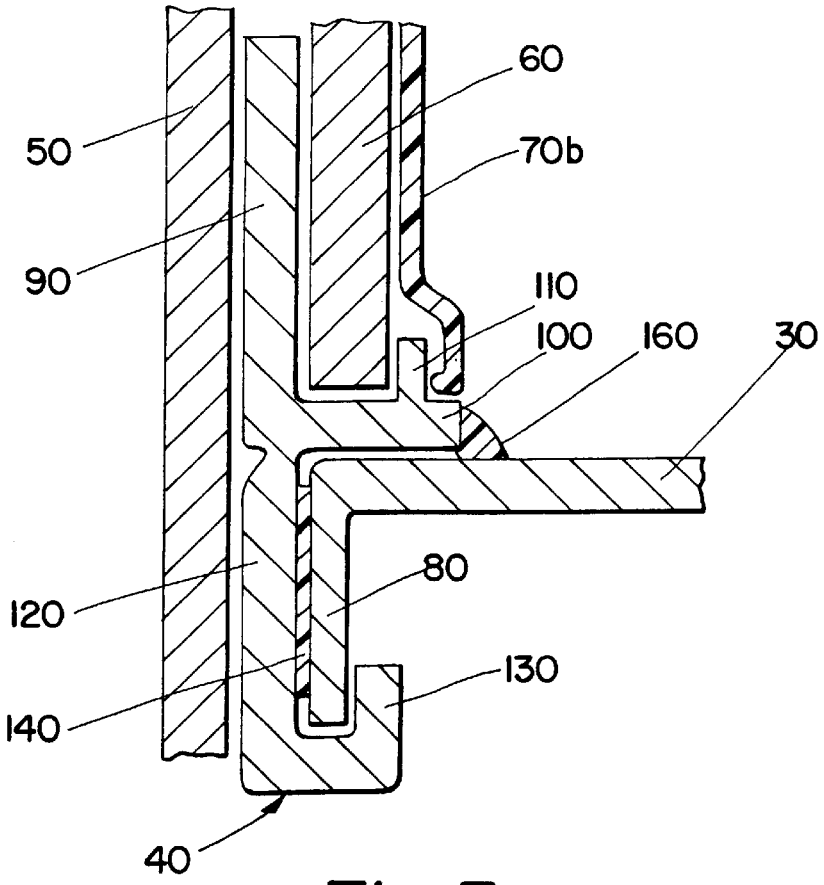
FIG. 3 is a schematic diagram taken substantially along line 2—2 of FIG. 1, illustrating in cross-section how the flange relates to the tub edge, tub deck, wall studs, drywall, and a plastic wall surround finish wall.

The finish wall is typically ceramic tile 70*a* or, as shown in FIG. 3, may be a plastic wall surround 70*b*.

In FIG. 2 the tub deck 30 extends downward to become a vertical tub edge 80.

Figure 4:
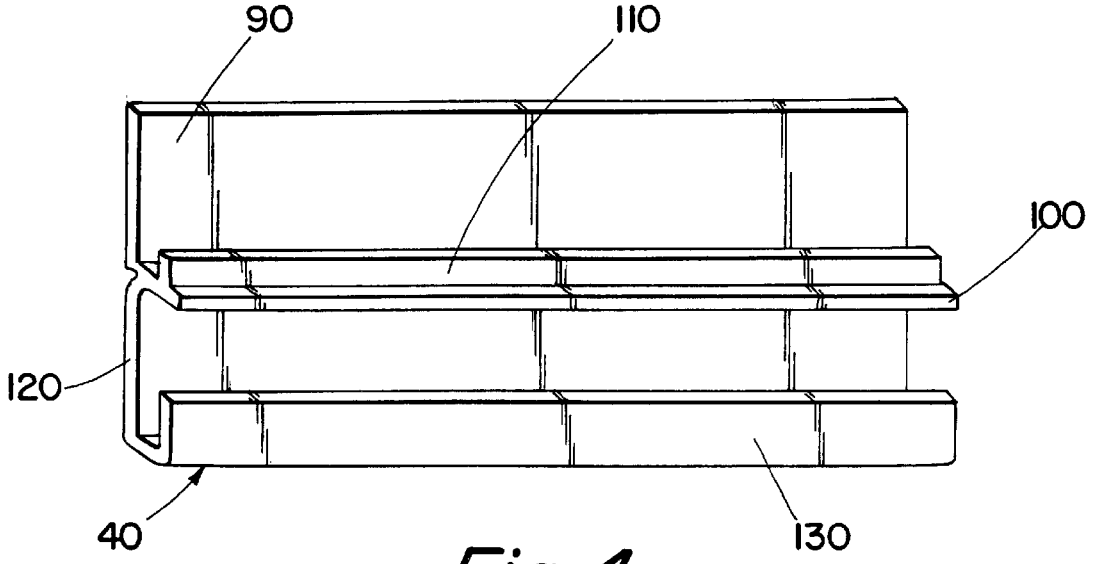
FIG. 4 is a perspective view of the tub support and sealing flange.

The support and sealing flange 40 shown in cross-section in FIGS. 2 and 3 and in perspective view in FIG. 4, is extrusion molded. In the preferred embodiment the flange material is made of ABS copolymers, but any suitably strong, flexible, resilient material capable of forming a moisture barrier may be used. It is to be understood that the parts of the support and sealing flange 40 described below are molded by the extrusion process into an integral and inseparable whole.

The tub support and sealing flange 40 includes a vertical back strip 90 through which a screw or like fastener 91 is passed to affix the flange 40 to the stud 50. The distance between the screw fastener and the tub deck 30 is not less than 7.9 mm (5/16 inch). Perpendicular to and contiguous with the back strip 90 is a finish wall sealing strip 100 of width appropriate to the combined thickness of the drywall 60 and the finish wall 70*a*, 70*b*.

Perpendicular to and contiguous with the finish wall sealing strip 100 is a vertical drywall sealing lip 110 appropriately positioned to seal the drywall 60. The back strip 90 and the drywall sealing lip 110 form a channel for the drywall 60.

In the preferred embodiment, the drywall sealing lip 110 is approximately 0.12 inches thick and extends to a height of approximately 0.37 inches above the tub deck 30.

Extending below the finish wall sealing strip 100, and contiguous and perpendicular to same, a tub edge securing strip 120 has an inwardly curving lip 130 to secure the tub edge 80. In the preferred embodiment the integrally molded tub support and sealing flange 40 snaps tightly on to the tub edge 80 and tub deck 30. The vertical height of the tub edge securing strip 120 closely approximates the distance between the tub deck 30 and the tub edge 80, so as to provide a tight seal between tub 10 and flange 40. Silicone adhesive 140 may be applied to the tub edge securing strip 120.

In use, the tub securing and sealing flange 40 is snapped on to the tub edge 80 and tub deck 30 after a layer of silicone adhesive 140 has been applied between the tub edge securing strip 120 and the tub edge 80. The tub 10 is next placed against the wall studs 50 and leveled. Screws or similar fasteners (not shown) are used to affix the vertical back strip 90 to the wall studs 50. Drywall 60 is next nailed to the wall studs 50. The lower edge of the drywall 60 fits snugly between the vertical back strip 90 and the drywall sealing lip 110.

In FIG. 2 tile adhesive 150 is layered on to the drywall 60 to the top edge of the drywall sealing lip 110. Ceramic tile 70*a* is attached to the drywall 60 by the layer of tile adhesive 150, the lower edge of the ceramic tiles 70*a* abutting the upper surface of the finish wall sealing strip 100. A final silicone bead 160 seals the junction between the finish wall sealing strip 100 and the tub deck 30.

In FIG. 3 an alternative use to that described for ceramic tile finish wall 70*a* of FIG. 2 is illustrated. In FIG. 3, the relationship between the tub support and sealing flange is the same as in the ceramic tile application described above (FIG. 2), except that a plastic wall surround 70*b* covers the drywall 60. The lower edge of the plastic wall surround 70*b* overlaps the drywall sealing lip 110 and abuts the finish wall sealing strip 100.

In the preferred embodiment the tub support and sealing flange is miter cut (not shown) at the corners formed by the deck and the intersection of the two adjacent walls, the cut being sealed with silicone adhesive to form a moisture barrier.

Although the invention has been shown and described with respect to certain preferred embodiments, it will be obvious to one skilled in the art that equivalent alterations and modifications may be made upon the reading and understanding of the specification. The present invention includes all such equivalent alterations and modifications, and is limited only by the scope of the claims.

What is claimed is:

1. A flange useful for sealing and securing a bathtub to a wall, the bathtub having a horizontal deck extending downward into a vertical edge, the wall having wall studs overlaid with drywall, which in turn is covered with tile adhesive and ceramic tiles, a plastic wall surround, or other finish wall, wherein said bathtub sealing and securing flange comprises:

means for securing the flange to the wall studs;

means for sealing the tub deck to the finish wall flexibly connected to said flange securing means;

means for sealing the drywall flexibly connected to said deck sealing means; and means for securing the tub edge to said flange securing means.

2. A flange useful for sealing and securing bathtub to a wall, the bathtub having a horizontal deck extending downward into a vertical edge, the wall having wall studs overlaid with drywall, which in turn is covered with tile adhesive and ceramic tiles, a plastic wall surround, or other finish wall, wherein said bathtub sealing and securing flange comprises:

means adapted for securing the flange to the wall studs;

means adapted for sealing the tub deck to the finish wall flexibly connected to said flange securing means;

means adapted for sealing the drywall flexibly connected to said deck sealing means; and means adapted for securing the tub edge to said flange securing means, wherein said drywall sealing means comprises a vertical drywall sealing lip parallel to said flange securing means adapted to form a seal between the front edge of the drywall and the back edge of the finish wall.

3. The flange of claim 1 wherein said deck sealing means comprises a finish wall sealing strip tightly adherent to the tub deck, perpendicular and flexibly joined at one end to said flange securing means, said finish wall sealing strip extending sufficient distance in front of said flange securing means to support and seal the lower edge of the drywall and finish wall covering.

4. The flange of claim 1 wherein said tub edge securing means comprises a substantially vertical tub strip running parallel to said flange securing means, the lower edge of said tub strip formed to capture the edge of the tub, said lower edge curved to provide a reverse J-shape on cross-section.

5. The flange of claim 1 wherein said flange securing means, finish wall sealing means, drywall sealing means and tub edge securing means, are formed of an extrusion molded plastic into an integral, unitary whole.

6. The flange of claim 5 wherein the plastic material is comprised of ABS copolymers.

7. The flange of claim 1 wherein said tub edge securing means includes a layer of silicone seal adhesive applied between said tub edge securing means and the tub edge.

8. The flange of claim 1 wherein said finish wall sealing means includes a bead of silicone seal at the junction between said finish wall sealing means and the tub deck.

9. An extrusion molded plastic flange useful for sealing and securing a bathtub to a wall, the bathtub having a horizontal deck extending downward into a vertical edge, the wall having a stud wall overlaid with drywall, the drywall being covered with a finish wall of the adhesive and ceramic tile or a plastic wall surround, wherein said bathtub sealing and securing flange comprises:

a. a vertical back strip running parallel to the stud wall, said back strip providing a surface for affixing the flange to the stud wall with fasteners;

b. a finish wall sealing strip perpendicular to and flexibly joined at one end to said vertical back strip, said finish wall sealing strip extending away from the back strip and adapted to extend to the outer edge of the finish wall;

c. a drywall sealing lip parallel to vertical back strip, perpendicular to and flexibly joined to said finish wall sealing strip, for forming a seal between the drywall, the finish wall and said finish wall sealing strip; said vertical back strip, said drywall sealing lip and said finish wall sealing strip forming a channel for the drywall; said drywall sealing lip and said finish wall sealing strip adapted to form a ledge to support, seal and align the finish wall; and d. a tub strip parallel to and flexibly joined to said vertical back strip, said tub strip having a lower edge for turning inward to capture the edge of the tub, said tub strip being of a width sufficient to bias said finish wall sealing strip tightly against the tub deck.

10. The flange of claim 9 wherein said tub strip includes a layer of silicone seal adhesive applied between said tub strip and the tub edge.

11. The flange of claim 9 wherein said finish wall sealing strip includes a bead of silicone seal at the junction between said finish wall sealing strip and the tub deck.

12. The flange of claim 9 wherein said flange is an extrusion molded plastic comprised of ABS copolymers.

13. The flange of claim 9 wherein said vertical back strip extends at least 5/16 inch above the tub deck.

14. A flange useful for sealing and securing a bathtub to a wall, the bathtub having a horizontal deck extending downward into a vertical edge, the wall having wall studs overlaid with drywall, which in turn is covered with tile adhesive and ceramic tiles, a plastic wall surround, or other finish wall, wherein said bathtub sealing and securing flange comprises:

means adapted for securing the flange to the wall studs;

means adapted for sealing the tub deck to the finish wall flexibly connected to said flange securing means;

means adapted for sealing the drywall flexibly connected to said deck sealing means; and means adapted for securing the tub edge to said flange securing means, wherein said deck sealing means comprises a vertical drywall sealing lip parallel to said flange securing means forming a seal between the front edge of the drywall and the back edge of the finish wall.

* * * * *